United States Patent [19]

von Langendorff

[11] 4,144,785

[45] Mar. 20, 1979

[54] PARTING TOOL

[75] Inventor: Vitmar G. von Langendorff, Tonawanda, N.Y.

[73] Assignee: Houdaille Industries, Inc., Fort Lauderdale, Fla.

[21] Appl. No.: 874,470

[22] Filed: Feb. 2, 1978

[51] Int. Cl.[2] ..... B26F 1/14

[52] U.S. Cl. ..... 83/685; 83/689; 83/916

[58] Field of Search ..... 83/685, 689, 916, 917

[56] References Cited

FOREIGN PATENT DOCUMENTS

| | | | |
|---|---|---|---|
| 94764 | 6/1923 | Austria | 83/689 |
| 402120 | 9/1924 | Fed. Rep. of Germany | 83/689 |

*Primary Examiner*—Frank T. Yost

*Attorney, Agent, or Firm*—Hill, Gross, Simpson, Van Santen, Steadman, Chiara & Simpson

[57] ABSTRACT

A punch and die assembly specifically adapted for use as a parting tool is disclosed. The punch has a working tip of rectangular cross section formed with a radius curved convex shear bottom. The punch mates with the die such that the punch side wall to die side wall clearance is maintained or increased at the corners.

8 Claims, 9 Drawing Figures

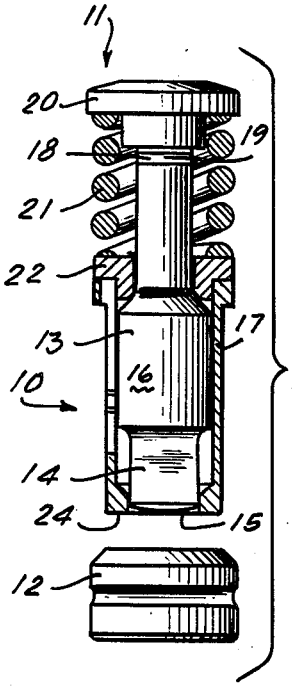
Fig. 1
Fig. 2
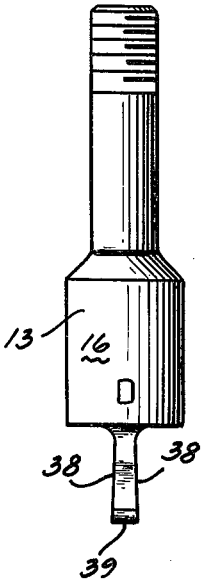
Fig. 3
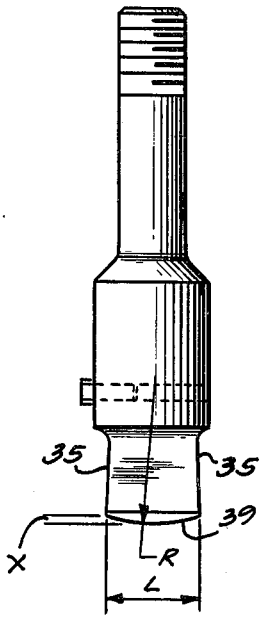
Fig. 4
(PRIOR ART)
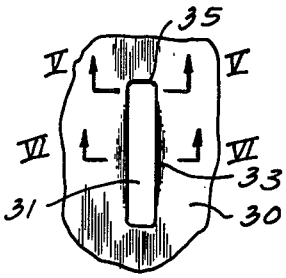
Fig. 5
(PRIOR ART)
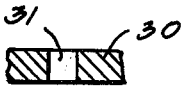
Fig. 6
(PRIOR ART)
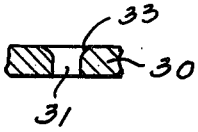
Fig. 7
(PRIOR ART)
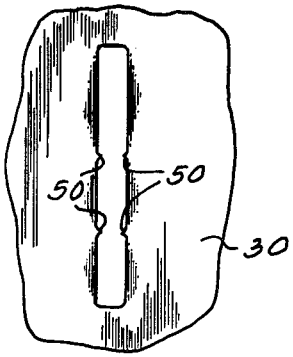
Fig. 8
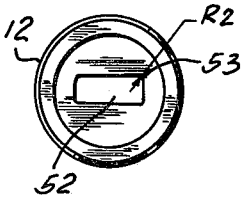
Fig. 9
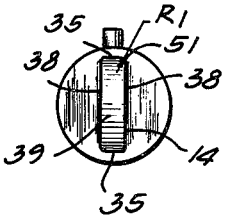

PARTING TOOL

BACKGROUND OF THE INVENTION

Field of the Invention

This invention relates to punching tools and more particularly to a parting tool punch and die assembly.

Prior Art

Automatic punching machines, and particularly turret punching machines having automatic workpiece movement control systems have the capability, through high speed repetitive punching, to function as a workpiece parting device. When so used, the workpiece is moved along a line by a distance between successive punches which is less than the dimension of the punch. In this manner a continuous line of material is removed from the workpiece and portions of the workpiece lying on opposite sides of that line are separated from one another.

This process can also be used for forming openings in a workpiece having a dimension larger than the dimension of the punch. In general this type of operation can be referred to as a "nibbling" operation.

When the machine is used for workpiece parting, the chosen punch and cooperating die normally have an elongated rectangular or obround cross section in order to minimize the width of the parting slot while simultaneously achieving an effective slot length for each punch stroke. Such elongated punches have been known in the past. One particular style is rectangular in cross section and may have rounded corners. While such prior punch and cooperating dies are effective in parting material, they have a distinct disadvantage in that resultant workpiece edge is generally unsatisfactory.

As the punch cooperates with the opposed die to shear material from the workpiece, the upper edge of the workpiece in the area of the removed material slot exhibits an edge depression known as rollover. This rollover, when associated with narrow elongated punches, is a phenomenon particularly associated with the longitudinal edges of the slot in the central regions of the slot. Thus rollover is minimized at the short side ends of the slot and maximized adjacent the center of the major dimension of the slot.

When an elongated punch is used in a nibbling mode with slightly overlapping punch contacts, the differences in rollover between the central portion of the slot major dimension edge and the end portion produces a series of spaced burrs or tips. These burrs can be quite evident along the edge of material parted by this nibbling technique. Such burrs are objectionable.

As another point, slot side wall projecting dimples can be produced at the corners of the punch tip. These are caused by the fact that the corner areas of the workpiece, when sharp corner punch and die sets are used, form the areas of highest stress concentration. Such dimples are likewise objectionable.

It would therefore be an advance in the art to provide a parting tool which minimizes rollover differential caused burrs and corner stressed caused dimples.

SUMMARY OF THE INVENTION

This invention overcomes the deficiencies of the prior art parting tools by providing a parting tool configuration and mating die configuration which provides substantially uniform minimum rollover along the length of the punched slot. Additionally by defining proper punch-die clearance at the corners of the punch, dimple formation is minimized.

According to the teachings of this invention, the punch tip is relatively narrow and elongated producing an elongated rectangular cross section having two short ends and two long side walls. The tip is convexly radiused from end wall to end wall while being substantially flat from side wall to side wall. The provision of the radius tip allows the parting tool to provide a gentle and uniform shearing action as the punch penetrates the metal workpiece. The uniform shearing action moves outwardly from the center portion of the punch along the punch edges. In this manner the punching load is more evenly distributed and the amount of rollover is made more uniform throughout the length of the parting tool.

Further, in the preferred embodiment, the parting tool tip corners are radiused and the die opening corners are provided with a complimentary radius. The relationship between the radius of the die corner and the radius of the punch tipped corner has a relationship to the punch side wall-die opening side wall clearance such that increased die clearance is maintained at the corners. This provision for increased corner clearance greatly reduces dimpling.

It is therefore an object of this invention to provide an improved parting tool.

It is another, and more particular object of this invention to provide a parting tool having a substantially elongated rectangular cross section working tip having a radius curvature end face from short end wall to short end wall.

It is another particular object of this invention to provide a parting tool punch having a working tip of substantially elongated rectangular configuration with rounded corners and a radiused bottom from short end to short end and a substantially flat bottom from side wall to side wall.

It is another specific object of this invention to provide a parting tool punch and die combination wherein the parting tool has an elongated substantially rectangular working tip having a bottom face which is radiused curved from short end wall to short end wall while being substantially flat from side wall to side wall, the punch corners being radius curved and the die slot corners having a radius curve with the punch corner to die corner clearance being substantially greater than the punch side wall to die side wall clearance.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

BRIEF DESCRIPTION OF THE DRAWINGS

FIG. 1 is a partially sectional view of a parting tool assembly according to this invention.

FIG. 2 is a side plan view of a punch body of the parting tool assembly of this invention.

FIG. 3 is a view similar to FIG. 2 illustrating the punch tool rotated 90° from the illustration of FIG. 2.

FIG. 4 is a fragmentary top plan view of a workpiece slotted by a prior art parting tool.

FIG. 5 is a fragmentary cross-sectional view taken along the lines V—V of FIG. 4.

FIG. 6 is a view similar to FIG. 5 taken along the lines VI—VI of FIG. 4.

FIG. 7 is a view similar to FIG. 4 illustrating the effects of overlapping usage of prior art parting tools.

FIG. 8 is a top plan view of the die of the assembly of FIG. 1.

FIG. 9 is a bottom plan view of the punch of the assembly of FIG. 1.

DESCRIPTION OF THE PREFERRED EMBODIMENT

As illustrated in FIG. 1, the parting tool assembly 10 of this invention includes a punch assembly 11 and a mating die 12. The punch assembly includes a punch body 13 having a working tip 14 with a tip end face 15. The punch body has a central section 16 reciprocatingly received in a combination stripper and punch guide 17. The end 18 of the punch body opposite the working tip 15 is threaded as at 19 and receives an adjustable cap nut 20 thereon. A stripper spring 21 is compressed between the cap nut 20 and a stripping guide engaging washer 22. As is known to the art, as the descending ram of a punching apparatus engages the nut 20 urging the punch assembly towards the die 12, the end face 24 of the guide will engage a workpiece lying between the punch assembly and the die. Thereafter further movement of the punch assembly will compress the stripping spring 21 tightly engaging the workpiece with the guide 17 which projecting the working tip 14 out of the end face of the guide and through the workpiece.

Standard prior parting tool punches were generally rectangular in cross section having flat shearing end faces. As they pass through the material of the workpiece, for example the workpiece 30 illustrated in FIGS. 4 through 6, the material of the workpiece at the top thereof adjacent the edges of the slot 31 being formed by the parting tool tended to "rollover" or become depressed. This roll-over, illustrated at 33, and best shown in FIG. 6, was maximized in the center areas of the longitudinal length of the slot 31 and was minimized adjacent the short ends 35.

Thus when the parting tool was used in a nibbling sequence where the workpiece is moved with respect to the parting tool between successive strokes of the parting tool by a distance which is less than the length of the working tip of the parting tool, the rollovers tend to become spaced along the length of the parting slot such that areas of lesser or minimum rollover alternated with areas of greater rollover. This condition, illustrated in FIG. 7 created an irregular surface at the edge of the parted material.

According to this invention, this irregular surface at the parted edge is minimized, by the use of a radius face 39 for the working tip 14. As best illustrated in FIG. 3, the radius R is generated along the longitudinal length of the working tip from short end 35 to short end 35. The length of the radius is chosen with respect to the longitudinal length L of the working tip and the depth of penetration of the punch interior of the die such that the peak height X of the radius is always less than the depth of penetration thereby assuring that the entire longitudinal length of the tip will project below the surface of the die to insure proper shearing of the workpiece material.

By using a radius tip, it has been found that rollover will be made substantially uniform throughout the entire length of the parting tool. The radius tip provides a more gentle and uniform shearing action as the punch penetrates the workpiece. In this it acts like a pair of scissors does in shearing material wherein breakout of the material to be removed by the parting tool from the workpiece uniformly moves along the edge of the sheared opening from the central portions thereof outwardly to the ends.

In order to provide effective shearing, the working tip is substantially flat from long side wall 38 to long side wall 38 as illustrated at 39 of FIG. 2. Further as illustrated in that figure, the wall 38 can have a slightly negative taper towards the central portion of the body such that the included angle at the tip face is slightly less than 90°.

It has also been found that by providing radius corners at the tip face with a definite relation to the radius corners of the die, that the previously encountered dimples 50 can be minimized. Such dimples have been produced by sharp corners of the punch and mating die which create areas of high stress. In order to reduce this problem, as illustrated in FIG. 9, the corners of the punch tip 39 are radiused as at 51. Likewise as illustrated in FIG. 8, the corners of the die opening 52 are radiused as at 53. The radius R1 of the punch is chosen so as to have a predetermined relationship with the radius R2 of the die.

As is known to those in the art, punches and dies are provided with a predetermined side wall clearance. This clearance is determined by the type and hardness of the material of the workpiece as well as the size and shape of the punch tip. It has been found that by increasing the clearance in the corners, that dimpling will be minimized. To this end, the radius R1 is maintained greater than the radius R2 of the die with the difference between R1 and R2 being slightly greater than the die side wall clearance. In this manner uniform rollover is exhibited on all sides and at the corners.

It is believed that at the very least the difference between R1 and R2 must be equal to the die side wall clearance in order to minimize dimpling. However, tests have shown that by increasing the corner clearance beyond the side clearance, that additional beneficial results are obtained. Tests have indicated that optimum results are obtained when the clearance in the corners is about 40% greater than the side wall clearance.

It can therefore be seen from the above that my invention provides a particularly effective parting tool punch and die assembly wherein the parting tool punch has a substantially rectangular elongated cross section working tip with a radius curvature longitudinally thereof. In the preferred embodiment, the curvature of the tip is such that its peak dimension is slightly less than the depth of penetration of the punch into the die. Additionally the working tip has a flat shear surface from long side wall to long side wall, the flat surface being at a substantially right angle to the axis of the punch. Further, the punch corners are also radius curved and cooperate with radius curved die corners with the difference between the radii of the punched corners and the die corners being greater than the die clearance.

Although the teachings of my invention have herein been discussed with reference to specific theories and embodiments, it is to be understood that these are by way of illustration only and that others may wish to utilize my invention in different designs or applications.

I claim as my invention:

1. A parting tool punch including a punch body having a projected working tip of substantially elongated rectangular cross section having relatively short end walls and relatively long side walls, the tip terminating in a free bottom end, the bottom end having a convex radius curvature from end wall to end wall and relatively flat surface from side wall to side wall, the tip having a central peak generated by said radius curvature, the peak having a maximum height differential from end wall to the central peak, the maximum height being less than a predetermined penetration depth of the punch tip when the punch tip is used in a punch apparatus in association with a mating die.

2. The punch of claim 1 wherein the side walls have a negative taper from the bottom end towards the remainder of the punch body and the flat surface extends substantially normal to the axis of the punch.

3. The punch of claim 2 wherein the short end walls and long side walls meet at punch tip corners, the punched tip corners being each curved on a radius.

4. A mating punch and die set comprising a punch member having a punch body having a projecting working tip of substantially elongated rectangular cross section having relatively short end walls and relatively long side walls, the tip terminating in a free bottom end, the bottom end having a convex radius curvature from end wall to end wall and a relatively flat surface from side wall to side wall, the side wall to end wall corners at the bottom end having a radius curvature of a first radius, a die member having a substantially rectangular die opening and a top face thereof defined by side and end walls dimensioned to provide a close tolerance clearance fit of the tip in the die opening, the die opening side wall to end wall corners having a radius curvature of a second radius differing from the first radius by an amount sufficient to provide a die corner to punch corner clearance at least substantially equal to the die side wall to punch side wall clearance when the punch tip is inserted into the die opening.

5. The punch and die set of claim 4 wherein the die corner to punch corner clearance is greater than the die side wall to punch side wall clearance.

6. The punch and die set of claim 5 wherein the die corner to punch corner clearance is approximately 40% greater than the die side wall to punch side wall clearance.

7. A mating punch and die set comprising a punch member having a punch body having a projecting working tip of substantially elongated rectangular cross section and having four radius bent corners, the tip terminating in a bottom end having a convex radius curvature, the die member having a substantially rectangular die opening dimensioned to receive the free bottom end of the punch tip in a clearance relationship, the punch and mating die having a long side wall to long side wall first clearance dimension and a corner to corner second clearance dimension, the second clearance dimension being greater than the first clearance dimension.

8. The set of claim 7 wherein the second clearance dimension is approximately 40% greater than the first clearance dimension.

* * * * *